US011771282B2

(12) United States Patent
Hahn et al.

(10) Patent No.: US 11,771,282 B2
(45) Date of Patent: Oct. 3, 2023

(54) METHOD FOR OPERATING AN AUTOMATICALLY MOVING CLEANING APPLIANCE

(71) Applicant: Vorwerk & Co. Interholding GmbH, Wuppertal (DE)

(72) Inventors: Pia Hahn, Schwelm (DE); Gerhard Isenberg, Cologne (DE); Harald Windorfer, Mettmann (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 610 days.

(21) Appl. No.: 16/100,542

(22) Filed: Aug. 10, 2018

(65) Prior Publication Data

US 2019/0045993 A1 Feb. 14, 2019

(30) Foreign Application Priority Data

Aug. 11, 2017 (DE) ..... 10 2017 118 380.9

(51) Int. Cl.
*A47L 9/28* (2006.01)
*A47L 9/00* (2006.01)

(52) U.S. Cl.
CPC ..... *A47L 9/2826* (2013.01); *A47L 9/009* (2013.01); *A47L 9/2852* (2013.01); *A47L 9/2857* (2013.01); *A47L 2201/04* (2013.01); *A47L 2201/06* (2013.01); *G05D 2201/0215* (2013.01)

(58) Field of Classification Search
CPC . A47L 2201/04; A47L 2201/06; A47L 9/2826
See application file for complete search history.

(56) References Cited

U.S. PATENT DOCUMENTS

2005/0162119 A1* 7/2005 Landry ..... A47L 5/362 318/580
2012/0169497 A1* 7/2012 Schnittman ..... G01V 8/20 340/540
2018/0199785 A1* 7/2018 Farmer ..... A47L 9/12
2020/0022551 A1* 1/2020 Watanabe ..... A47L 9/30

FOREIGN PATENT DOCUMENTS

DE 10 2008 014 912 A1 9/2009
DE 10 2011 000 536 A1 8/2012

* cited by examiner

*Primary Examiner* — Bryan R Muller
(74) *Attorney, Agent, or Firm* — Collard & Roe, P.C.

(57) ABSTRACT

A method for operating a cleaning appliance, which moves automatically inside a surrounding area, wherein the cleaning appliance performs a cleaning of a defined spatially defined partial surface area of the surrounding area. To optimize the cleaning operation as a function of a measured soiling, it is proposed that a detection device of the cleaning appliance measures a level of soiling of the partial surface area during the cleaning of the partial surface area, wherein the level of soiling is compared to a defined reference level of soiling and wherein the partial surface area is enlarged automatically by adding a defined additional partial area, which adjoins the partial surface area, if a level of soiling above the reference level of soiling is determined inside the partial surface area.

6 Claims, 5 Drawing Sheets

METHOD FOR OPERATING AN AUTOMATICALLY MOVING CLEANING APPLIANCE

CROSS REFERENCE TO RELATED APPLICATIONS

Applicant claims priority under 35 U.S.C. § 119 of German Application No. 10 2017 118 380.9 filed on Aug. 11, 2017, the disclosure of which is incorporated by reference.

BACKGROUND OF THE INVENTION

1. Field of the Invention

The invention relates to a method for operating a cleaning appliance, which moves automatically inside a surrounding area, wherein the cleaning appliance performs a cleaning of a defined spatially defined partial surface area of the surrounding area.

The invention furthermore relates to a cleaning appliance, which moves automatically inside a surrounding area, which is embodied to perform a cleaning of a defined spatially defined partial surface area of the surrounding area.

2. Description of the Related Art

Cleaning appliances of the above-mentioned type as well as methods for the operation thereof are known in the prior art.

The cleaning appliance can for example by a mobile robot, which can automatically perform a vacuuming task and/or mopping task.

Publications DE 10 2011 000 536 A1 and DE 10 2008 014 912 A1 disclose for example methods in connection with automatically movable vacuum cleaning and/or cleaning robots for cleaning floors. The robots are equipped with distance sensors, which are able to measure distances to obstacles, such as for example pieces of furniture or room demarcations. A surrounding area map, by means of which a movement route can be planned, which avoids a collision with obstacles, is prepared from the measured distance data. The distance sensors preferably operate in a contact-free manner, for example with the help of light and/or ultrasound. It is furthermore known to provide the robot with means for the all-around distance measurement, for example with an optical triangulation system, which is arranged on a platform or the like, which rotates around a vertical axis. The captured distance data is processed into a surrounding area map by means of a computing device of the robot and is stored, so that this surrounding area map can be used in the course of an operation for the purpose of orientation.

It is furthermore known in the prior art to automatically control the operation of the cleaning appliance, for example in that the cleaning appliance travels across a movement route, which is planned in advance, or performs a spot cleaning of a defined spatially defined partial surface area, which is performed with a cleaning power, which is increased as compared to a standard mode. During the spot cleaning mode, the robot intensively cleans a smaller partial surface area of the surrounding area of for example 2 times 2 meters. Inside this partial surface area, the robot moves for example in straight, parallel lines. When the robot has travelled across its predefined path inside the spot, it returns to a starting point.

It is disadvantageous thereby that the cleaning of the spatially defined partial surface area takes place independently of a level of the soiling of this partial surface area.

SUMMARY OF THE INVENTION

Based on the above-mentioned prior art, it is the object of the invention to vary the cleaning operation of the cleaning appliance as a function of a soiling of the partial surface area.

To solve this object, it is proposed that a detection device of the cleaning appliance measures a level of soiling of the partial surface area during the cleaning of the partial surface area, wherein the level of soiling is compared to a defined reference level of soiling and wherein the partial surface area is enlarged automatically by adding a defined additional partial area, which adjoins the partial surface area, if a level of soiling above the reference level of soiling is determined inside the partial surface area.

According to the invention, a partial surface area treated by the cleaning appliance is now enlarged under certain conditions as a function of a determined level of soiling of the partial surface area. A limitation of the partial surface area is changed, in that a defined additional partial area is added to the previous surface of the partial surface area. The additional partial area can be defined in terms of its size, shape and/or position.

It can in particular be defined, how sensitively the partial surface area is expanded as a function of a detected level of soiling, so that for example in the case of only slight soiling, a different adaptation of the partial surface area takes place than in the case of levels of soiling, which are relatively high in comparison. The level of soiling of the partial surface area is determined for example by means of a dust sensor. The reference level of soiling can be manually defined by a user or can also be derived from a level of soiling of an earlier cleaning cycle. The reference level of soiling can furthermore be stored in a surrounding area map for the cleaning appliance, as a function of the location, so that different reference levels of soiling are assigned to different partial surface areas of a surrounding area, for example different rooms of a home. In response to a comparison of a currently detected level of soiling of a partial surface area with a defined reference level of soiling, a decision is made for example, whether the cleaning of the partial surface area is ended or whether the partial surface area is increased by adding an additional partial area. Information about the partial surface area cleaned in this way can subsequently be stored in the surrounding area map for future cleaning cycles of the cleaning appliance. The user can furthermore carry out a plurality of different actions after a cleaning cycle, he can for example make a decision, whether or not the previously cleaned partial surface area, including the additional surface area, is to be cleaned again. The user can further store information about concluded cleaning cycles via an application stored on an external terminal, for example information about whether a supplemented additional partial area had been chosen to be too large or too small, whether the cleaning quality met the expectations of the user or the like. For example a leaning behavior of the cleaning appliance can also be achieved by means of this approach.

It is furthermore proposed that a spot cleaning mode is carried out in the defined spatially defined partial surface area with cleaning power, which is increased as compared to a standard mode of the cleaning appliance. According to this embodiment, a decision is made during a spot cleaning mode of the cleaning appliance, whether the partial surface area is supplemented with additional partial areas, which are then also subject to a cleaning according to the settings of the spot cleaning mode. In the spot cleaning mode, the cleaning appliance can for example initially be placed at a circumferential line of the partial surface area to be cleaned. From there, the cleaning appliance moves for example in straight, parallel lines through the partial surface area and cleans it. The partial surface area can for example have a surface of 2 times 2 meters. The level of soiling of the partial surface area is measured by means of the detection device during the spot cleaning and is compared to the defined reference level of soiling. Provided that the detected soiling is larger than the reference soiling, the partial surface area is enlarged by an additional partial area. Otherwise, the spot cleaning is ended or is at least limited to the surface of the previous partial surface area.

It can furthermore be provided that the cleaning appliance moves inside the partial surface area and/or inside the additional partial surface area on a meander-shaped movement path or on movement paths, which are oriented parallel to one another. The partial surface area is thus not travelled according to a random pattern, but along a defined movement route, which can have regular or irregular patterns. Particularly preferably, a movement is carried out along parallel movement paths or along a meander-shaped movement path. When adding an additional partial area to the partial surface area, the movement path or the movement paths respectively, of the cleaning robot is/are extended accordingly into the additional partial area, wherein the movement pattern preferably basically remains the same.

It is in particular proposed that the level of soiling is detected along a circumferential path, which defines the partial surface area. On principle, the detection device can detect a soiling at every point of the partial surface area, but to assess a required enlargement of the partial surface area, it is in particular advisable to evaluate only, if applicable, the soiling of an outer circumferential path of the partial surface area. For this purpose, the cleaning appliance can systematically move along the circumferential path, which defines the partial surface area, and can measure a soling along the circumferential path there. In the alternative, the cleaning appliance can move through the partial surface area on a meander-shaped movement path or on movement paths, which are oriented parallel to one another, and can measure the level of soiling at that location, where the movement path crosses the circumferential path. Regardless of whether the detection device detects the soiling only in the area of the circumferential path, which defines the partial surface area, or also centrally inside the partial surface area, only a level of soiling at the outer circumferential path is preferably compared to the reference level of soiling, so as to make a decision about whether the partial surface area is enlarged by adding an additional partial area.

It is furthermore proposed that the partial surface area is expanded by an additional partial area beyond a circumferential path, which defines the partial surface area, at least in the area of a circumferential path section. It is in particular proposed that the partial surface area is expanded in the area of a circumferential path section, which has a level of soiling above the defined reference level of soiling. This embodiment considers, on which side of the partial surface area a threshold level of soiling was exceeded, so that an expansion of the partial surface area takes place only at that location, where the threshold value had been exceeded. Provided that the partial surface area is for example a rectangular partial surface area comprising four straight circumferential path sections, the partial surface area can be expanded on one of the rectangle sides, thus resulting in a shifting of the corresponding circumferential path section and thus in a one-sided enlargement of the partial surface area. An expansion of the partial surface area will thus preferably be made in the direction of the increased level of dirt, which is particularly advantageous under the aspect of the cleaning efficiency.

In the context of this embodiment, it can furthermore be provided that it is avoided in response to a movement of the cleaning appliance through the enlarged partial surface area that the cleaning appliance moves repeatedly across certain locations. This can be avoided in that in the case of surface expansion on opposing circumferential path sections, the cleaning appliance initially cleans one of the added additional partial areas and gradually expands the latter radially to the outside, if applicable, and only moves into the opposing additional partial area only at that point, in order to clean there. The percentage of the locations inside the partial surface area or of the additional partial areas, respectively, which are covered repeatedly, is thus kept as low as possible. As a whole, the expansion of the partial surface area at only a few of the available circumferential path sections results in an irregular expansion of the partial surface area, so that the shape of the partial surface area can also change asymmetrically during the course of a cleaning, if applicable.

It is furthermore proposed that the partial surface area, based on a circumferential path defining the latter, is expanded helically and/or by adding one or a plurality of rectangular additional partial areas. In the case of the helical expansion of the partial surface area along the circumferential path, the original surface of the partial surface area is enlarged in its entirety and continuously by an additional partial area of a defined width. Preferably, a detected amount of dirt is thereby continuously compared to a threshold value, while the cleaning appliance moves along the circumferential path. The helical expansion of the partial surface area results in a substantially even expansion of the partial surface area in all directions. However, the circumferential path of the partial surface area or of the added additional partial areas, respectively, thereby does not inevitably need to run in a curved manner, for example along a circularity, but can for example also be of a square, triangular or another design. In response to the supplementation of the partial surface area by one or a plurality of rectangular additional partial areas as further proposed, a rectangular partial surface area can for example be expanded on one or a plurality of sides by adding rectangular additional partial areas. An asymmetrical expansion of the partial surface area can also be created thereby.

According to a particularly simple embodiment, it can be provided that the partial surface area is expanded by a frame-like additional partial area. In the case of this embodiment, the partial surface area is expanded along its entire circumference. Based on a square partial surface area, this means that all sides of the square are expanded by an additional partial area of identical or different width. A square partial surface area, in turn, is created thereby. In the case that the partial surface area is embodied to be round, the frame-like additional partial area is a ring of a defined width, which expands the radius of the partial surface area in all possible radial directions.

It is proposed that the partial surface area is supplemented by one or a plurality of additional partial areas until a soiling below the defined reference soiling is detected. The expansion of the partial surface area by one or a plurality of additional partial areas is thus continued, until an abort criterion has been fulfilled. The abort criterion includes here that a soiling measured by the detection device is smaller than a defined reference soiling. A decision is made by means of an algorithm executed by a control device of the cleaning appliance, whether or not the cleaning is ended as a result of a level of soiling, which is too low.

It can furthermore be provided that a size and/or shape of an additional partial area is varied as a function of a level of soiling of the partial surface area. It can thus be established, how sensitively the partial surface area is expanded as a function of a detected level of contamination. Different categories can in particular be created for the size of the additional partial area, which, in the case of only a slight soiling, has a smaller size than in the case of a stronger soiling.

In addition to the above-described method for operating a cleaning appliance, which automatically moves inside a surrounding area, the invention furthermore also proposes a cleaning appliance, which automatically moves inside a surrounding area, which is embodied to perform a cleaning of a defined spatially defined partial surface area of the surrounding area, wherein the cleaning appliance has a control device, which is set up to control the cleaning appliance to carry out an above-proposed method.

According to the invention, the control device is thus set up to measure a level of soiling of the partial surface area during the cleaning of a partial surface area, to compare the measured level of soiling to a defined reference soiling, and to automatically enlarge the partial surface area by adding a defined additional partial area, when a level of soiling above the reference soiling is determined. The advantages and further features of the cleaning appliance according to the invention thereby result as described above with regard to the method.

The control device can in particular control the cleaning appliance and the detection device in such a way that the soiling is detected along a circumferential path, which defines the partial surface area.

The control device can furthermore expand the partial surface area beyond a circumferential path, which defines the partial surface area, at least in the area of a circumferential path section, by an additional partial area, in particular in the area of a circumferential path section, which has a soiling above the defined reference soiling. However, the control device can also be set up to expand the partial surface area helically and/or by supplementing one or a plurality of rectangular additional areas and/or by adding a frame-like additional partial area.

A storage device comprising a file, which includes reference levels of soiling as well as sizes, shapes and/or positions for corresponding additional partial areas, can furthermore be assigned to the control device. A certain size and/or shape and/or position of an additional partial area can in particular be assigned to a certain detected level of soiling, for example in table form. The file, which the control device can access, can either be stored locally inside the cleaning appliance, or on an external terminal, an external server, or for example also on a web server (Cloud).

BRIEF DESCRIPTION OF THE DRAWINGS

The invention will be described in more detail below by means of exemplary embodiments.

BRIEF DESCRIPTION OF THE DRAWINGS

Figure 1:
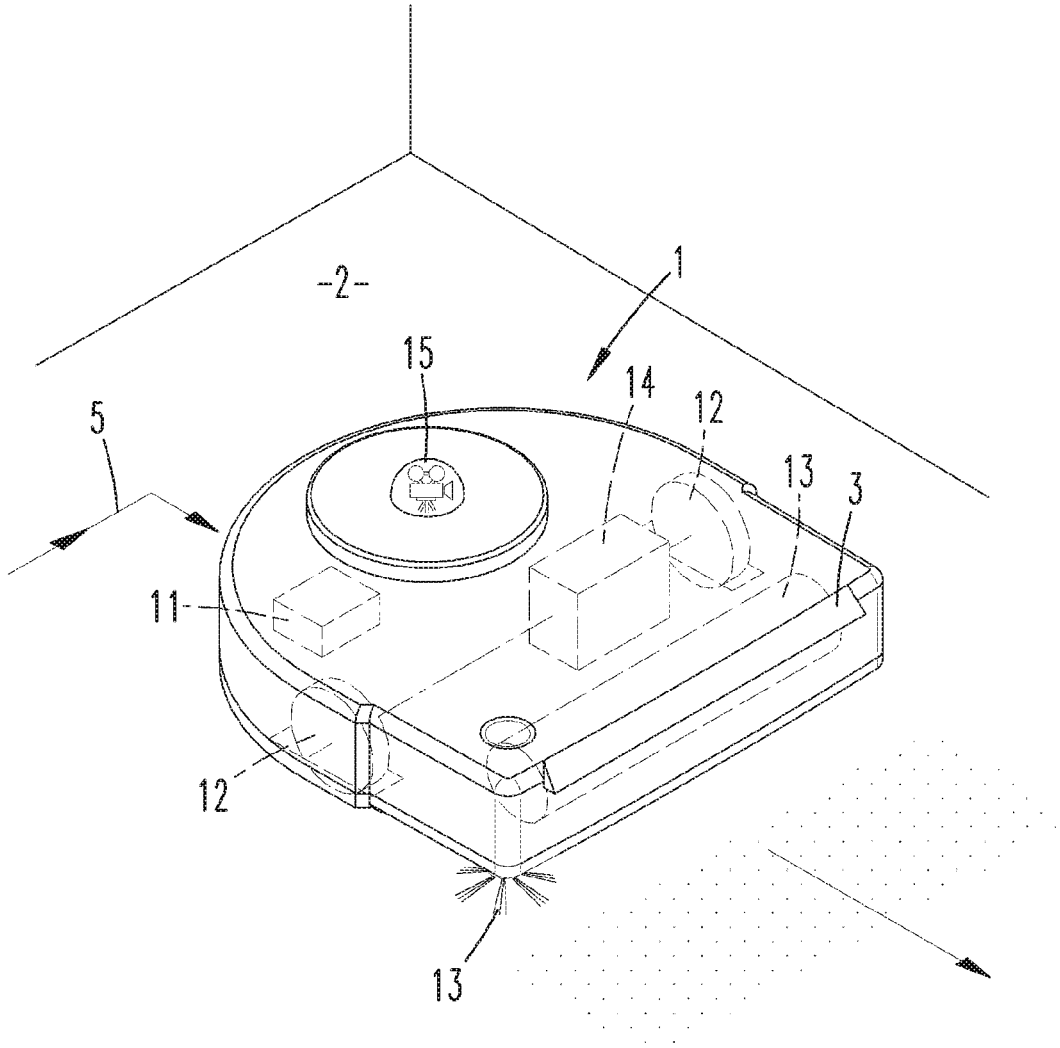
FIG. 1 shows a perspective view of a cleaning appliance.

FIG. 1 shows a cleaning appliance 1, which is embodied as vacuum cleaner robot here. The cleaning appliance 1 has wheels 12, which are driven by an electric motor 14 and with the help of which the cleaning appliance 1 can move inside a surrounding area. The cleaning appliance 1 furthermore has cleaning elements 13, namely here a side brush, which protrudes laterally beyond a housing of the cleaning appliance 1, as well as a bristle roller, which can be rotated about an axis of rotation. In the typical operating position of the cleaning appliance 1 illustrated here, the bristle roller is oriented horizontally, based on its longitudinal extension, i.e. substantially parallel to a surface to be cleaned. The cleaning elements 13 serve to release dirt from the surface to be cleaned. In the area of the cleaning elements 13, the cleaning appliance 1 furthermore has a suction nozzle opening, which is not illustrated in detail, via which air, to which suction material is applied, can be sucked into the cleaning appliance 1 by means of a motor-fan unit. For the power supply of the individual electrical components, the cleaning appliance 1 has a non-illustrated, rechargeable accumulator.

The cleaning appliance 1 furthermore has a distance measuring device 15, which includes for example a triangulation measuring device here. The distance measuring device 15 is arranged inside the housing of the cleaning appliance 1 and has, in detail, a laser diode, the emitted light beam of which is guided out of the housing via a deflecting device, and which can be rotated about an axis of rotation, which is perpendicular in the shown orientation of the cleaning appliance, in particular at a measuring angle of 360 degrees. An all-around distance measurement around the cleaning appliance is thus possible. The distance measuring device 15 measures distances to obstacles, for example pieces of furniture, inside the surrounding area of the cleaning appliance 1.

The cleaning appliance 1 furthermore has a detection device 3, namely here a dust sensor, which is arranged in the front in the moving direction of the cleaning appliance 1, and which can detect a soiling of a partial surface area 2, across which the cleaning appliance 1 currently moves. Here, the dust sensor includes for example an image capturing device, in particular a camera, which takes pictures of the partial surface area 2 and compares them to pictures of a reference soiling. The cleaning appliance 1 has a control device 11, which is embodied to make the comparison between a soiling captured by the detection device 3 and the reference soiling. For this purpose, the control device 11 can access an internal or external storage device (not illustrated), in which information relating to reference soiling is stored.

To clean one or a plurality of partial surface areas 2, the cleaning appliance 1 completes a movement path 5 inside the surrounding area. This movement path 5 can for example be planned by means of a surround area map 16 (see FIGS.

5 and 6), which the cleaning appliance 1 has prepared beforehand. The movement path 5 can for example furthermore also be a movement route of the cleaning appliance 1 during a spot cleaning mode, in which the cleaning appliance 1 cleans a limited partial surface area 2 with cleaning power, which is increased as compared to a standard mode. In this cleaning mode, the cleaning appliance 1 moves across the partial surface area 2 for example on a plurality of paths, which are parallel to one another, and removes a soiling.

Based on the operation of the cleaning appliance 1 in such a spot cleaning mode, FIGS. 2 and 4 will now be described in more detail. It goes without saying that it is also possible that the cleaning appliance 1 acts similarity based on a standard mode.

The spot cleaning initially starts inside a partial surface area 2, which has a previously-defined standard size for spot cleaning, here for example a rectangular surface with a size of 2 times 2 meters. A circumferential path 6 as circumferential line of the partial surface area 2 defines the spot area and has four circumferential path sections 7, 8, 9, 10, which are each of a 90° angle relative to one another. Initially, the cleaning appliance 1 performs a cleaning of the partial surface area 2 along parallel paths (not illustrated in the figures) in the usual way. The detection device 3 thereby detects a soiling of the partial surface area 2. The cleaning appliance 1 subsequently covers a distance, which runs along the circumferential path 6 of the partial surface area 2, on a movement path 5. The movement path 5 is here preferably oriented in such a way that the cleaning appliance 1 is still located completely inside the circumferential path 6 during the movement along the movement path 5, but moves maximally close to the circumferential path 6. During the movement, the detection device 3, in turn, detects a soiling of the partial surface area 2, which is subsequently used to assess a required enlargement of the partial surface area 2. If necessary, the previously detected soiling of the entire partial surface area 2 can also be considered additionally, but this is not absolutely necessary. The control device 11 of the cleaning appliance 1 determines a level of soiling of the partial surface area 2 by means of the detected soiling along the movement path 5, and compares it to one or plurality of defined reference levels of soiling, which are stored in a data storage, which the control device 11 can access. Provided that the determined level of soiling lies above a defined reference level of soiling, the partial surface area 2 is enlarged along the entire circumferential path 6, i.e. in the area of all circumferential path sections 7, 8, 9, 10, by an additional partial area 4, so that the enlarged partial surface area 2, which is illustrated in FIG. 2 on the right, results. The size of the additional partial area 4 can be varied as a function of the intensity of the soiling, so that in the case of a stronger soiling, a broader additional partial area 4 is supplemented than in the case of only a slight soiling. The cleaning appliance 1 also performs a spot cleaning in the added additional partial area 4 of the partial surface area 2, which can also be performed by moving through parallel paths. During the cleaning operation, which is performed inside the additional partial area 4, a soiling is detected again by means of the detection device 3 and is compared to one or a plurality of defined reference soiling. Provided that a reference level of soiling is exceeded, in turn, the partial surface area 2 is expanded again by an additional partial area 4. This approach is repeated, until a determined level of soiling falls below a relevant reference level of soiling.

Figure 3:
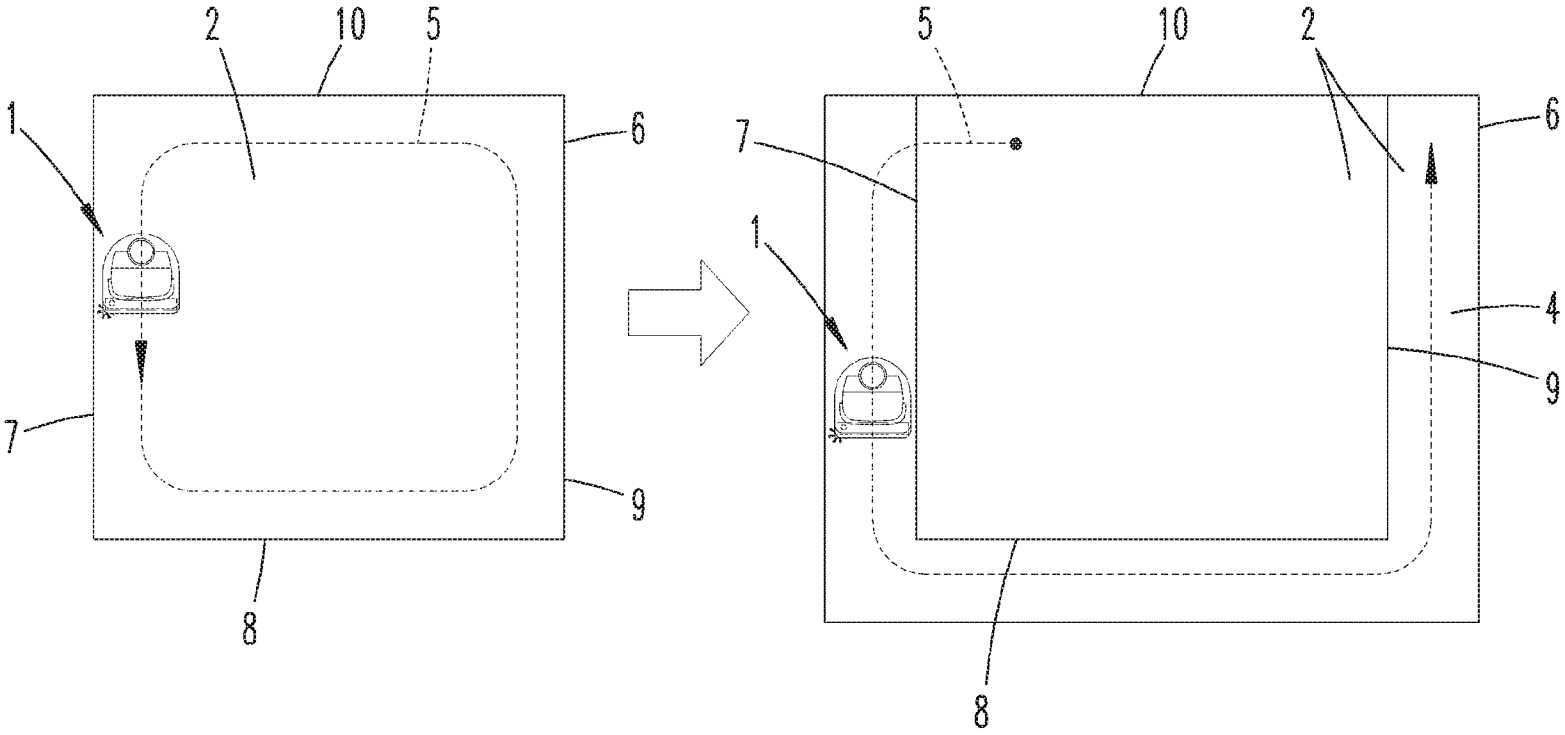
FIG. 3 shows a cleaning appliance in a partial surface area prior to and after adding an additional partial area according to a second embodiment.

FIG. 3 shows a modified method, in the case of which it is considered, at which circumferential section 7, 8, 9, 10 of the partial surface area 2 a reference level of soiling is exceeded, so that the original partial surface area 2 is supplemented with an additional partial area 4, which have an amount of dirt, which is increased as compared to the reference soiling, only at those circumferential path sections 7, 8, 9, 10. In the Figure, this relates to the circumferential path sections 7, 8 and 9. An expansion of the partial surface area 2 is thus made only in the direction of the increasing level of dirt, so that the cleaning of the partial surface area 2 can be performed particularly effectively, in particular in the course of a spot cleaning.

Figure 4:
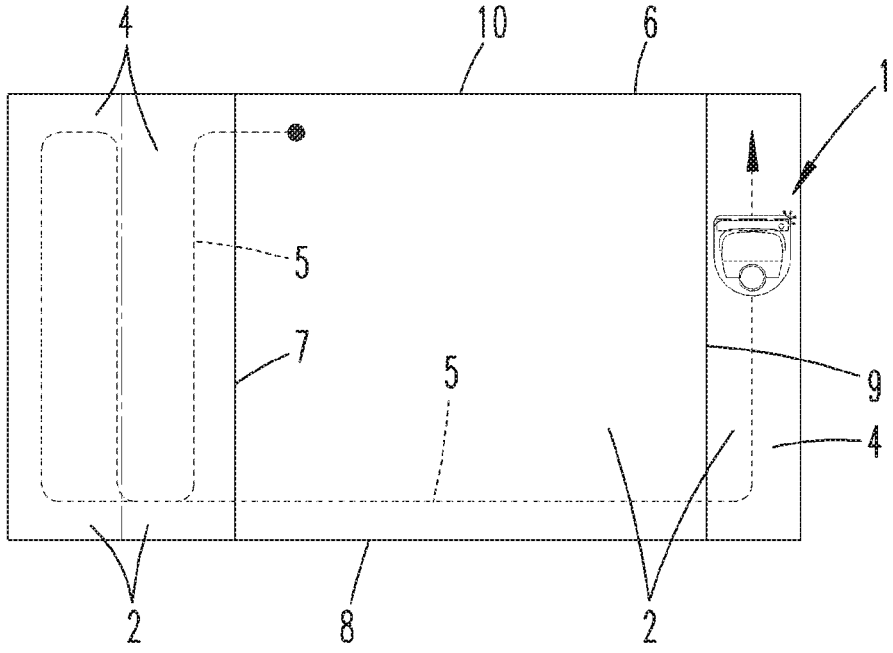
FIG. 4 shows an asymmetrically expanded partial surface area.

FIG. 4 shows a further method, which prevents or at least reduces a repeated moving across an area of the partial surface area 2. In the case of this embodiment, the partial surface area 2 is first expanded in one direction, when an increased soiling is present in the area of opposing circumferential path sections 7, 9, until the detected soiling falls below a reference soiling there. In the Figure, this is the area next to the circumferential path section 7. As described above, the partial surface area 2 is expanded by one or a plurality of additional partial areas 4 there, here two additional partial areas 4, until the defined threshold value for the soiling is fallen below. The cleaning appliance 1 subsequently approaches the opposing circumferential path section 9 and moves there into the additional partial area 4, which has also been supplemented, cleans it and continues a cleaning in a further additional partial area 4 next to the circumferential path section 9, if necessary, until a level of soiling determined there lies below the defined reference level of soiling.

Figure 2:
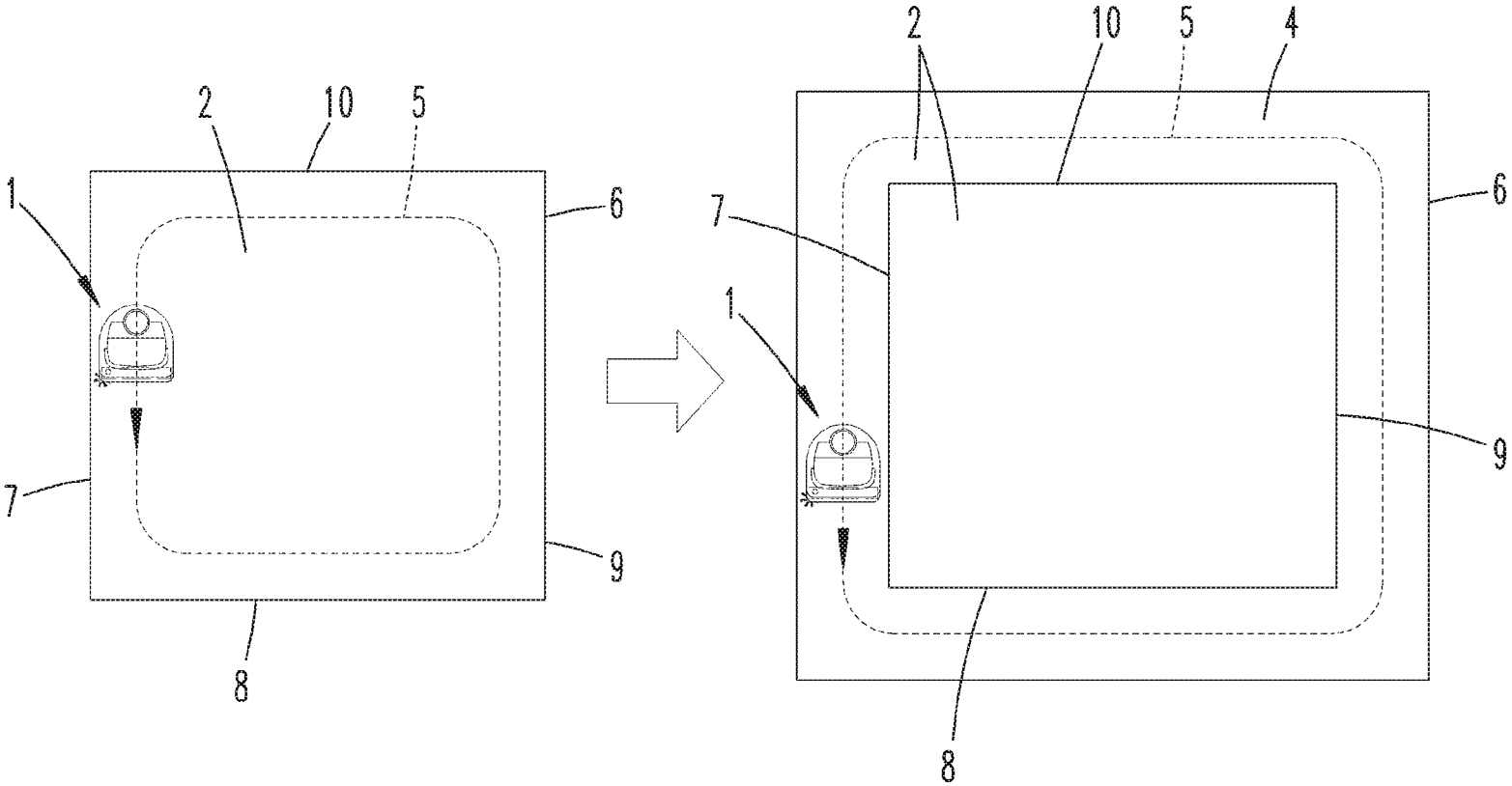
FIG. 2 shows a cleaning appliance in a partial surface area prior to and after adding an additional partial area according to a first embodiment.

On principle, the enlargement of the partial surface area 2 can take place in different ways, for example by means of a frame-like additional partial area 4, as illustrated in FIG. 2, by means of an expansion of the partial surface area 2 by additional partial areas 4 only on certain circumferential path sections 7, 8, 9, 10, as illustrated in FIG. 3, or also by means of a helical expansion of the partial surface area 2 according to a moving direction of the cleaning appliance 1 along the movement path 5 parallel to the circumferential path 6 of the partial surface area 2, wherein additional partial areas 4 are supplemented one by one in the movement direction on the circumferential path 6 of the partial surface area 2. This results in a helical continuation and expansion of the partial surface area 2 in the circumferential as well as in the radial direction.

Figure 5:
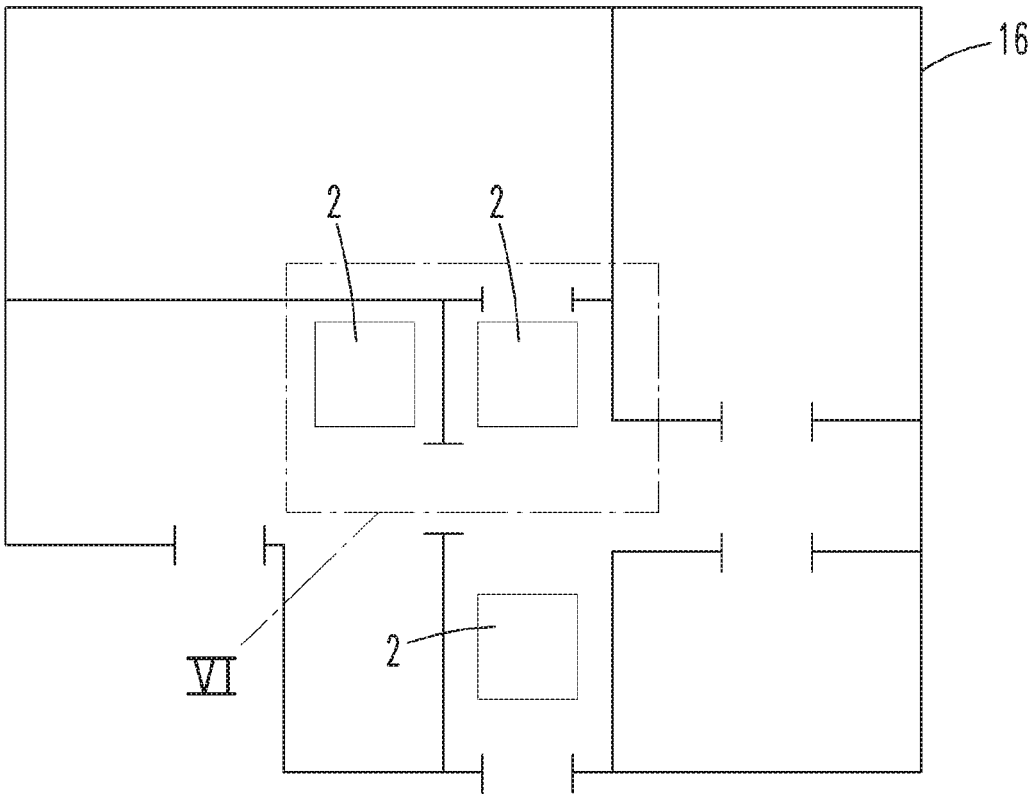
FIG. 5 shows a surrounding area map of the cleaning appliance with partial surface areas stored therein.

FIG. 5 shows a surrounding area map 16 prepared by the cleaning appliance 1, in which partial surface areas 2 are stored, at which a spot cleaning is to be performed. The partial surface areas 2 are marked with a standard size of for example 2 times 2 meters here.

Figure 6:
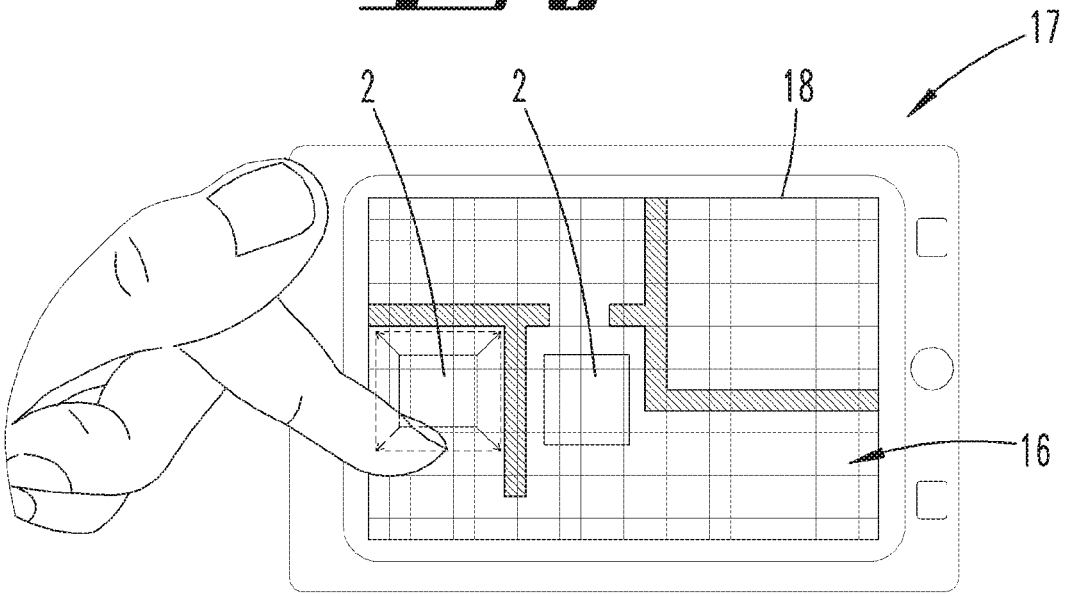
FIG. 6 shows an external terminal for interaction with the cleaning appliance.

As illustrated in FIG. 6, a user can access the surrounding area map 16 of the cleaning appliance 1 by means of an external terminal 17. An application, which displays the surrounding area map 16 on a display 18 of the external terminal 17, is installed on the external terminal 17, here a tablet computer. The user can transmit a feedback to the cleaning appliance 1, for example after a spot cleaning has ended, by means of a user input on the display 18, which is embodied as touchscreen here. The user can select for example a partial surface area 2, which is to be cleaned again. The user can furthermore input information relating to a performed cleaning, for example information about whether a partial surface area 2, which is automatically adapted by the cleaning appliance 1, had been chosen to be too large or too small. The cleaning quality can furthermore be assessed.

LIST OF REFERENCE NUMERALS 1 cleaning appliance
2 partial surface area

3 detection device
4 additional partial area
5 movement path
6 circumferential path
7 circumferential path section
8 circumferential path section
9 circumferential path section
10 circumferential path section
11 control device
12 wheel
13 cleaning element
14 electric motor
15 distance measuring device
16 surrounding area map
17 external terminal
18 display

What is claimed is:

1. A method for operating a cleaning appliance, which moves automatically inside a surrounding area, comprising:

Cleaning a spatially defined partial surface area that has a previously-defined standard size for spot cleaning and is defined by a circumferential line defining a circumferential path with multiple circumferential path sections, wherein the cleaning takes place with a cleaning power that is increased as compared to a standard mode of the cleaning appliance, by the cleaning appliance completing a movement path inside the surrounding area, and subsequently covering with the cleaning appliance a distance that runs along the circumferential path of the partial surface area;

measuring with a detection device of the cleaning appliance, during the step of covering, a level of soiling of the defined partial surface area along the circumferential path, comparing the measured level of soiling of the defined partial surface area to a defined reference level of soiling;

automatically enlarging the partial surface area beyond the circumferential path by adding an additional partial area, which adjoins the partial surface if a level of soiling above the reference level of soiling is determined along the circumferential path, repeating the steps of cleaning, covering, measuring, comparing and automatically enlarging until a determined level of soiling falls below the reference level of soiling, wherein the partial surface area is expanded beyond the circumferential path by the additional partial area only next to a circumferential path section, which covers an extent that is less than the circumferential path and which has a level of soiling above the defined reference level of soiling, wherein when adding the additional partial area to the partial surface area, the movement path of the cleaning appliance is extended into the additional partial area, so that a surface area cleaned by the appliance expands asymmetrically during the cleaning, and wherein a size and/or shape of the additional partial area is varied as a function of a level of soiling of the partial surface area, wherein to establish how sensitively the partial surface area is expanded as a function of the detected level of contamination, the level of soiling is compared to reference levels of soiling, which are stored in a file in a storage device along with sizes and shapes for corresponding additional partial areas, and a certain shape of an additional partial area is assigned to a certain detected level of soiling so that the size and shape of the additional partial area is determined by matching the detected level of soiling with one of the reference levels of soiling in the file.

2. The method according to claim 1, wherein the cleaning appliance moves inside the partial surface area and/or inside the additional partial surface area on a meander-shaped movement path or on movement paths, which are oriented parallel to one another.

3. The method according to claim 1, wherein the partial surface area, based on the circumferential path defining the partial surface area, is expanded helically and/or by adding one or a plurality of rectangular additional partial areas.

4. The method according to claim 1, wherein the partial surface area is expanded by a frame-like additional partial area.

5. The method according to claim 1, wherein the partial surface area is supplemented by the one or a plurality of additional partial areas until a soiling below the defined reference soiling is detected.

6. A cleaning appliance, which automatically moves inside a surrounding area, which is embodied to perform a cleaning of a spatially defined partial surface area of the surrounding area, that has a previously-defined standard size for spot cleaning and is defined by a circumferential line defining a circumferential path with multiple circumferential path sections, wherein the cleaning takes place with a cleaning power that is increased as compared to a standard mode of the cleaning appliance, by the cleaning appliance completing a movement path inside the surrounding area and subsequently covering a distance that runs along the circumferential path of the partial surface area;

wherein the cleaning appliance has a detection device configured to measure during the covering of the distance along the circumferential path a level of soiling of the defined partial surface area along the circumferential path, wherein the cleaning appliance has a control device that is configured to compare the measured level of soiling to a defined reference level of soiling and automatically enlarge the partial surface area beyond the circumferential path by adding an additional partial area, which adjoins the partial surface if a level of soiling above the reference level of soiling is determined along the circumferential path, wherein the control device is configured to cause the cleaning appliance to repeat the cleaning, covering, measuring, comparing and automatically enlarging until a determined level of soiling falls below the reference level of soiling, wherein the control device is configured to expand the partial surface area beyond the circumferential path by the additional partial area only next to a circumferential path section that covers an extent that is less than the circumferential path and which has a level of soiling above the defined reference level of soiling, wherein when adding the additional partial area to the partial surface area, the movement path of the cleaning appliance is extended into the additional partial area, so that a surface area cleaned by the appliance expands asymmetrically during the cleaning, and wherein the control device is configured to vary a size and/or shape of the additional partial area as a function of a level of soiling of the partial surface area, wherein to establish how sensitively the partial surface area is expanded as a function of the detected level of contamination, the control device has a storage device having a file, which includes reference levels of soiling as well as sizes and shapes for corresponding additional partial areas, so that a certain shape of an additional partial area is assigned to a certain detected level of soiling, so that the size and shape of the additional partial area is determined by matching the detected level of soiling with one of the reference levels of soiling in the file.

* * * * *